United States Patent [19]

Conway

[11] Patent Number: 4,570,792

[45] Date of Patent: Feb. 18, 1986

[54] CASE FOR CURLING IRON OR SIMILAR ARTICLE

[76] Inventor: Kay S. Conway, 8025 E. Lincoln #273, Scottsdale, Ariz. 85253

[21] Appl. No.: 652,279

[22] Filed: Sep. 20, 1984

[51] Int. Cl.[4] ..... A45C 11/00; B65D 81/38

[52] U.S. Cl. ..... 206/349; 206/328; 206/372; 206/525; 150/52 R; 383/110; 132/79 R

[58] Field of Search ..... 206/349, 372, 373, 363, 206/328, 334, 525, 526, 527; 383/110, 89; 150/52 R; 132/79 R, 36 R, 36 B, 31 R

[56] References Cited

U.S. PATENT DOCUMENTS

| | | | |
|---|---|---|---|
| 1,679,101 | 7/1928 | Sternthal | 206/372 |
| 2,707,721 | 5/1955 | Anderson et al. | 150/52 R |
| 3,066,847 | 12/1962 | Fortune | 383/110 |
| 3,446,420 | 5/1969 | Rinecker | 383/89 |
| 3,986,648 | 10/1976 | Antonini et al. | 206/363 |
| 4,021,197 | 5/1977 | Brooks | 206/526 |

*Primary Examiner*—William T. Dixson, Jr.
*Attorney, Agent, or Firm*—Don J. Flickinger

[57] ABSTRACT

An insulative sheath having an open end and a closed end including a substantially non-combustionable heat resistant flexible inner liner and a flexible outer covering for encasing a curling iron or similar article. A foldable flap selectively closes the open end of the sheath for retaining the curling iron. The power cord of the iron is secured by a tie strap affixed to the sheath.

6 Claims, 7 Drawing Figures

CASE FOR CURLING IRON OR SIMILAR ARTICLE

BACKGROUND OF THE INVENTION

1. Field of the Invention

This invention relates to stowage and carrying cases.

More particularly, the present invention relates to cases especially adapted for use in connection with selected electrical appliances.

In a further and more specific aspect the instant invention concerns an improved case for receiving a curling iron or similar article which may contain residual heat.

2. The Prior Art

The curling iron is a well-known article, routinely employed by innumerable females during which the frequent cosmetics and adornment regimens. The devices are utilized for primary operations, such as initially imparting curls to the hair during the creation of a coiffure; and for secondary operations, such as touching-up or redoing previously styled hair. Attributable in part to compactness and convenience, curling irons have attained tremendous popularity.

While specific features of design and construction are subject to the individual criteria of the several commercial manufacturers, various analogous components are identifiable. Commonly, curling irons are generally elongate cylindrical devices including a heatable member such as a thermo conductive tube encasing an electrical resistance element. A handle, fabricated of insulative material extends from one end of the heatable member. Electrical energy is supplied to the resistance element by a power cord extending through the handle. Also usually provided is a hingedly affixed semi-cylindrical element which retains the hair wrapped about the heatable element.

A curling iron functions to set the curl in the hair as a result of heat generated in the resistanace element transmitted through the conductive tube. After use, residual heat remains in the heatable element for a considerable period of time. When used at home or other permanent locations, residual heat is of relatively little consequence since the device may be simply left upon a counter top or vanity until cooled.

During travel, however, the residual heat presents a major inconvenience. The curling iron is usually stowed in a vanity case or a suitcase in an environment which includes items that can be damaged or destroyed when subjected to heat. Use of a curling iron is usually a terminal undertaking before leaving a place of temporary lodging such as a hotel or motel. As will be readily appreciated by those having use of such a device considerable, inconvenience is caused by the delay necessary for the curling iron to cool prior to proper stowage.

The prior art is replete with various cases, receptacles and holders for such items as spectacles, camera accessories and blackjacks. Not provided by the prior art, however, is a solution to the dilemma of a traveler having need of a curling iron. It is noted that a mobile worker or hobbiest having need of a soldering iron, a device having a general visual and functional similarity to a curling iron, encounters a similar perplexity.

It would be slightly advantageous, therefore, to remedy the foregoing and other deficiencies inherent in the prior art.

Accordingly, it is an object of the present invention to provide improvements in travel or carrying cases.

Another object of the invention is the provision of a case especially adapted for the stowage of curling irons and similar articles.

And another object of the invention is to provide a case which will accommodate a curling iron or similar article still containing residual heat.

Still another object of the immediate invention is a case which will protect the environment from the article stowed therein.

Yet still another object of this invention is the provision of means while will permit a curling iron to be placed in a vanity case or the like before the iron has cooled.

A further object of the invention is to provide a carrying case having accommodation for the power cord normally associated with curling irons and like articles.

And a further object of the instant invention is the provision of a case which may be fabricated in random selected decorative designs.

Still a further object of the invention is to provide a carrying or travel case that is readily and conveniently usable.

And still a further object of the invention is the provision of a case, of the above character, which is economically and durably constructed.

SUMMARY OF THE INVENTION

Briefly, to achieve the desired objects in the instant invention in accordance with a preferred embodiment thereof, first provided is an insulative sheath for receiving and enclosing the heatable member of a curling iron or a similar article. Also provided are retention means for retaining the heatable element within the sheath.

In accordance with the a further embodiment of the invention, the insulative sheath includes an elongate tubular element having an open end for receiving the article therethrough and a closed end for receiving the free end of the heatable element. The securement means includes a flap carried by the tubular element and foldable over the open end and securable to the tubular by fastening means. Normally, the handle of the curling iron resides adjacent to the flap.

In accordance with an even further embodiment of the invention, the tubular element includes a substantially noncombustionable heat resistant flexible inner liner and a flexible outer covering. An insulative and cushioning layer resides intermediate the inner liner and the outer covering. Further provided are retention means, such as an elongate flexible element for encircling and holding the power cord of the article in close proximately to the sheath.

BRIEF DESCRIPTION OF THE DRAWINGS

The foregoing and further and more specific objects and advantages of the instant invention will become readily apparent to those skilled in the art from the following detailed description of the preferred embodiments thereof taken in conjunction with the drawings in which.

DETAILED DESCRIPTION OF THE PREFERRED EMBODIMENTS

Figures 1, 2, 3, 4, 5, 6, 7:
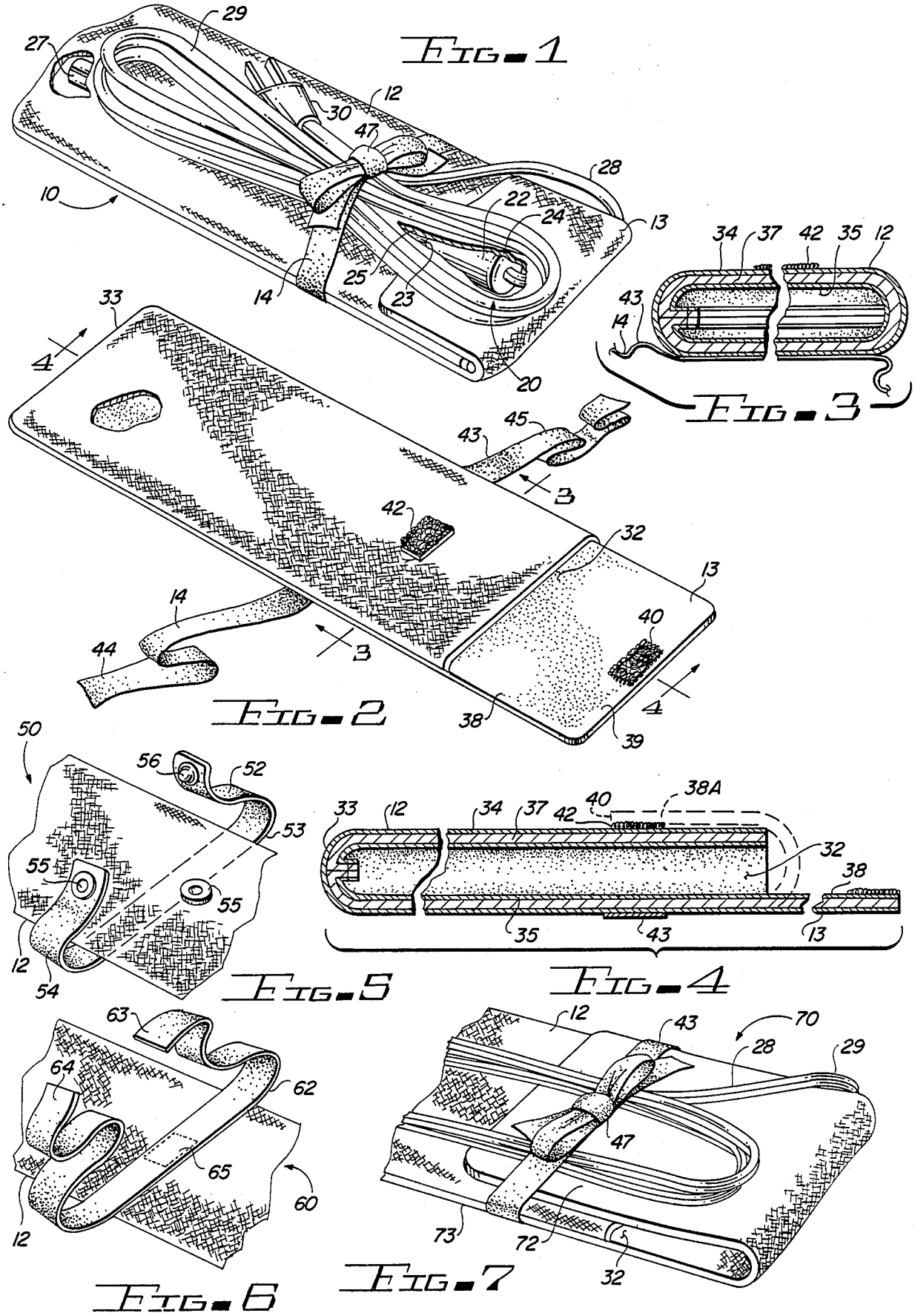
FIG. 1 is a perspective view of a travel or carrying case construction in accordance with the teachings of the instant invention as it would appear when having a curling iron stowed therein, portions of the case being broken away for purposes of illustration.
FIG. 2 is a perspective view of the case of FIG. 1 as it would appear when ready for receiving a curling iron.
FIG. 3 is an enlarged fragmentary vertical sectional view taken along view line 33 of FIG. 2.
FIG. 4 is an enlarged fragmentary vertical sectional view taken along 44 of FIG. 2.
FIG. 5 is a perspective view of fragmentary intermediate portion generally corresponding with the illustration of FIG. 2 and joining an alternate embodiment thereof.
FIG. 6 is a perspective is a fragmentary perspective view generally corresponding to the view of FIG. 5 and showing yet an alternate embodiment thereof.
FIG. 7 is a partial perspective view generally corresponding to the right hand end of the casing in FIG. 1 and showing an alternate embodiment thereof.

Turning now to the drawings, in which like referenced characters indicate corresponding elements throughout the several views, attention is first directed to FIG. 1 which shows a case generally designated by the reference character 10 and embodying the principles of the instant invention. As viewed in the immediate illustration and subject to further description hereinafter, case 10 includes an insulative sheath 12, securement means 13 and retention means 14.

Stowed within case 10, for purposes of reference and orientation, is a curling iron generally designated by the reference character 20. Being a generally elongate cylindrical article, curling iron 20 includes handle 22 having attachment end 23 and free end 24. An elongate heatable member 25 extends from the attachment end 23 of handle 22 and terminates with free end 27. Power cord 28 for supplying electrical energy to heatable element 25, includes an elongate flexible conductor, such as insulation covered wire 29, projecting from the free end 24 of handle 22 and terminating with plug 30 adapted to be received in a standard electric outlet or receptacle. A more comprehensive understanding of curling iron 20, which is intended to be representative of such articles, will be had by those skilled in the art.

In accordance with the immediately preferred embodiment of the invention, as further viewed in FIGS. 2, 3, and 4, insulative sheath 12 comprises an elongate tubular element having an open end 32, a closed end 33, an outer covering 34, an inner liner 35, and an intermediate layer 37 residing therebetween. Inner liner 35 is fabricated of a substantially noncombustible heat resistant flexible material such as the silicone sealed fabric commonly used for ironing board covers. Outer covering 34 may be fabricated of any selected flexible material, natural or synthetic, which is selected to have aesthetic value. Intermediate layer 37 which provides additional thermal insulation and cushioning effect, is preferably fabricated of an expanded material such as commonly referred to as batting.

Securement means 13 of the immediate embodiment, as best viewed in FIGS. 1, 2 and 4, includes flap 38 which is foldable over the open end 32 of insulated sheath 12 and includes a terminal portion 39 which is securabe to the tubular element. In the immediate embodiment, fastening means for securing terminal portion 39 to the insulated sheath 12 is in the form of the hook and loop fastening means commonly distributed under the tradename VELCRO. In accordance with conventional technique, an element 40 of the fastening means is carried by the terminal portion 30 of flap 38 while a complimental element 42 is appropriately affixed to the outer covering 34.

Flap 38 is shown in the open position in FIG. 2. In FIG. 4., flap 38 is represented in the folded configuration, closing the open end 32 of sheath 12, by the broken outline designated 38A. It is within the scope of the instant invention that flap 38 be integral with sheath 12 or, alternately, be a separate element attached thereto by stitching or other appropriate means compatible with the material of construction. It will be appreciated by those skilled in the art, flap 38 extends from a predetermined portion, generally approximately one half of the open end 32 of sheath 12.

Preferably, in accordance with the immediately preferred embodiment of the invention, retention means 14 is in the form of an elongate flexible element or ribbon 43 which is secured at an intermediate location to what may be considered the reverse or backside of sheath 23. First and second segments, 44 and 45, of ribbon 43 extent laterally from respective sides of sheath 12. Ribbon 43 is secured to sheath 12 by any conventional means consistent with the materials of construction, as will be appreciated by those skilled in the art.

During use of case 10, curling iron 20 is received through open end 32 and inserted until free end 27 of heatable member 25 resides approximate closed end 33 of sheath 12. With power cord 28 extending laterally, flap 38 is folded over handle 22 and secured by the previously described fastening means. Accordingly, heatable member 25 is retained within insulated sheath 12. Finally, power cord 28 is doubled and redoubled as necessary, placed against sheath 29 and secured by retention means 14. For this purpose, segments 44 and 45 may be gathered and formed in to a conventional bow or knot 47 as specifically seen in FIG. 1.

With reference with to FIG. 5 there is seen an alternate embodiment generally designated by the reference character 50 having sheath 12 and flap 38 (not specifically herein illustrated), as previously described. The fastening means associated with the instant embodiment includes an elongate ribbon element 52 affixed to sheath 12 as previously described and having oppositely extending first and second segments 53 and 54, respectively. An element 55 and a complimental element 56 of a conventional snap fastening device are carried by respective ends of the segments 54 and 52. The elements 55 and 56 provide for the joining of the segments 52 and 54 for the purpose of retaining power cord 28 as an alternative to the knot 47 previously described.

As further seen in FIG. 5, another element 55 of a conventional snap fastening device is seen as secured to sheath 12. As will be appreciated by those skilled in the art, the complimental element of the snap fastening means, immediately engageable with element 55, is carried by the terminal portion of flap 38 for retaining the flap in the folded and closed position as previously described.

Another embodiment of the instant invention generally designated by the reference character 60 is seen with reference to FIG. 6. Herein, the retention means is in the form of yet another elongate ribbon like element 62 secured to sheath 12 and terminating with oppositely extending segments 63 and 64. Preferably, the ribbon like element 62 is secured at an intermediate location thereof to what is considered the back side of sheath 12 by a relatively small pattern of stitching 65. The segment 63 and 64 are tied into a knot or bow, as previously designated by the reference character 47 in FIG. 1, to retain the power cord. It is apparent that the immediate fastening means secures the power cord independent of the sheath 12.

Turning now to FIG. 7, there is seen yet another embodiment of the invention generally designated by the reference character 70, which in general similarity to the embodiment of FIG. 1, includes insulated sheath 12 and a fastening means in the form of an elongate element 43. The immediate securement means is in the form of a flap 72 having terminal portion 73. Flap 72 is substantially of greater length, although otherwise similar in construction, to the previously described flap 38. Accordingly, the terminal portion 73 will reside under and be secured by the segments 44 and 45 when formed into a bow or knot 47.

Various changes and modifications to the embodiments herein chosen for purposes of illustration will readily occur to those skilled in the art. For example, the flap may be secured to the sheath by other conventional means than those specifically depicted. The retention means may be secured to any selected portion of the case and be arranged for encircling and holding the power cord on either side of the device. It is also anticipated that various materials will be selected consistent with the objectives to be obtained. It being understood that the foregoing detailed description is by way of example and not limitation, such modifications and variations are intended to be included within the scope of the invention which is assessed only by a fair interpretation of the following claims.

Having fully described and disclosed the present invention in such clear and concise terms as to enable those skilled in the art to understand and practice the same.

The invention claimed is:

1. A case for stowage of a curling iron or similar article, which device includes a handle having an attachment end and a free end, an elongate heatable member extending from the attachment end of said handle and having a free end, and an elongate flexible power cord extending from said handle, and for protecting the environment from residual heat within said heatable member said case comprising:

a. an insulative sheath for receiving and encasing the heatable member of said device; and b. securement means for retaining said heatable element within said sheath.

2. The case of claim 1, wherein:

a. said insulative sheath includes an elongate tubular element having i. an open end for receiving said article therethrough, and ii. a closed end for receiving the free end of said heatable member; and b. said securement means includes i. a flap carried by said tubular element and foldable over the open end thereof and having a terminal portion, and ii. fastening means for selectively securing the terminal portion of said flap to said tubular element.

3. The case of claim 2, wherein said tubular element includes:

a. a substantially noncombustible heat resistant flexible inner liner; and b. a flexible outer covering.

4. The case of claim 3, further including an insulative intermediate layer residing between said inner liner and said outer covering.

5. The case of claim 1, further including retention carried by said tubular element means for holding said power cord in close proximity to said sheath.

6. The case of claim 5, wherein said retention means includes an elongate flexible element for encircling said power cord after said cord has been at least doubled.

* * * * *